US007201032B2

(12) United States Patent
Pfitzner

(10) Patent No.: US 7,201,032 B2
(45) Date of Patent: Apr. 10, 2007

(54) TRANSILLUMINATION UNIT

(75) Inventor: Dieter Pfitzner, Weil der Stadt (DE)

(73) Assignee: Trumpf Maschinen Austria GmbH & Co. KG, Pasching (AT)

( * ) Notice: Subject to any disclaimer, the term of this patent is extended or adjusted under 35 U.S.C. 154(b) by 0 days.

(21) Appl. No.: 11/071,983

(22) Filed: Mar. 4, 2005

(65) Prior Publication Data

US 2005/0223772 A1 Oct. 13, 2005

(30) Foreign Application Priority Data

Mar. 5, 2004 (AT) ..... A 392/2004

(51) Int. Cl.
*B21J 13/10* (2006.01)

(52) U.S. Cl. ..... 72/420; 72/17.3; 72/37; 72/422; 382/152; 348/95; 700/259

(58) Field of Classification Search ..... 72/17.3, 72/18.1, 18.5, 19.4, 37, 389.3, 420, 421, 72/422; 382/141, 152; 348/94, 95; 356/622; 700/259

See application file for complete search history.

(56) References Cited

U.S. PATENT DOCUMENTS 5,329,597 A * 7/1994 Kouno et al. ..... 382/152
5,950,484 A 9/1999 Kutschker
5,987,958 A 11/1999 Moore, Jr. et al.
6,317,953 B1 * 11/2001 Pryor ..... 29/407.04
6,466,843 B1 * 10/2002 Bonanni et al. ..... 700/245
6,644,080 B2 * 11/2003 Lindstrom ..... 72/19.4
6,958,769 B2 * 10/2005 Shoenfeld ..... 348/88

FOREIGN PATENT DOCUMENTS

DE 196 39 590 A1 4/1998
WO WO 03/095125 A2 11/2003

* cited by examiner

*Primary Examiner*—Ed Tolan
(74) *Attorney, Agent, or Firm*—Alston & Bird LLP

(57) ABSTRACT

A metal sheet-receiving system for receiving parts and feeding a metal sheet-folding machine, particularly a folding press comprising at least one manipulator for seizing and moving metal sheet parts with a gripper head fitted with gripping means; an electronic controlling device for controlling the movements of the manipulator; as well as a measuring system for determining the position of the metal sheet parts. The measuring system is formed by an opto-electronic measuring device, particularly an image acquisition means, and a transillumination platform.

17 Claims, 2 Drawing Sheets

TRANSILLUMINATION UNIT

BACKGROUND OF THE INVENTION

1. Field of the Invention

The invention relates to a metal sheet receiving system for receiving metal sheet parts and feeding a metal sheet folding machine, particularly a folding press, comprising at least one manipulator for seizing and moving metal sheet parts, with a gripper head fitted with gripping means; an electronic control device for controlling the movement of the manipulator, as well as a measuring system for determining the position of the metal sheet parts. Furthermore, the invention relates to a method for picking up metal sheet parts from a stack of such parts, and for positioning such metal sheet parts in a metal sheet folding machine, particularly a folding press by means of a metal sheet receiving system comprising at least one manipulator for seizing and moving the metal sheet parts with a gripper head fitted with gripping means; an electronic control device for controlling the movement of the manipulator, as well as a measuring system for determining the position of the metal sheet parts.

2. Prior Art

Conventional metal sheet receiving systems for metal sheet folding machines, particularly for folding presses, comprise a manipulator in most cases, which is positioned in a defined position upstream of the metal sheet processing machine and feeds the metal sheet parts to the folding press from a readying system. The exact position for gripping the metal sheet parts, which is a precondition that must be satisfied for their exact placement in the press, can be set by exactly aligning the metal sheet parts in the readying system, on the one hand, or by detecting the alignment of the edges of the metal sheet parts by means of a special, in most cases mechanical detector device, on the other hand. However, such methods require complicated devices and have been found to be very time-consuming on the one hand, and relatively imprecise on the other. Another possibility is to implement a metal sheet recognition method by means of sensors arranged on the manipulator, which permits dispensing with an exact alignment of the metal sheet parts in the readying device.

DE 196 39 590 A1 describes a folding center comprising a feeding device with a placement table, as well as a manipulator arrangement, among other components. For improving the feeding rates, the feeding device has a sensor which determines the position of the received metal sheet part in relation to a defined position for feeding said part into a folding cell. In an advantageous embodiment, the sensor is formed by a light barrier arranged on a fork. The drawback here is that any clear distinction or determination of the metal sheet parts is highly time-consuming, and furthermore not feasible in each case particularly with shapes of metal sheets that are very similar to one another.

SUMMARY OF THE INVENTION

The problem of the invention is to provide a metal sheet receiving system and a method for receiving the metal sheet parts that permit a quick and safe identification of the metal sheet parts.

Said problems of the invention are each independently resolved by a metal sheet receiving system of the type specified above, whereby the measuring system is formed by an optoelectronic measuring device, in particular an image acquisition system, and a transillumination platform, and by the method for picking up metal sheet parts, by which a metal sheet part is picked up with the gripping means of the manipulator and fed to a transillumination platform; whereby at least part areas of the transillumination platform are illuminated by an illumination system on the side facing away from the gripping means of the manipulator; an image of the metal sheet part, particularly of a part area of the latter, is acquired by means of an optoelectronic measuring system of the measuring system; the outline data are computed by a computer based on the data of the image; a new gripping position or correction of the position of the gripper head is computed based on such outline data; and the metal sheet part is picked up by the gripper head in the new gripping position, or its position is corrected by the gripper head, and then fed to the metal sheet folding machine. The advantage gained herewith is that the metal sheet part can be quickly and safely recognized even with complex shapes of metal sheets or individual holes and recesses in the sheet, which permits reducing the cycle times and number of rejects. Another benefit is gained in connection with reflecting or galvanized surfaces of the metal sheet because any conventional illumination, particularly flash illumination will cause strong reflections that make any safe recognition of the metal sheet impossible, or would require complicated counter measures such as multiple image generation, particularly image generation with polarized light etc. Such reflections are avoided by the illumination by means of the transillumination table as defined by the invention, and a high contrast of the image generated is produced at the same time in order to determine the position of the metal sheet part with high accuracy.

According to a design variation, provision is made that the transillumination platform is forming a support surface for the metal sheet parts, which ensures that the latter are deposited at an exactly defined level in an exactly defined position without requiring any additional depositing devices, which permits achieving optimal quality of the optoelectronic measurement, as well as optimal contrast.

The fact that part areas of the support surface are formed by a transparent material leads to the benefit that the transillumination platform is provided with higher mechanical stability because part areas that are not transparent, for example, can be formed by materials with higher stability such as, e.g. metals.

It is possible also to provide the transillumination platform with an illumination system that is arranged on a side facing away from the support surface for the metal sheet parts, and extending over at least 30% of the surface area of the part areas. It is possible in this way to achieve in a beneficial manner high contrast for the optoelectronic measurement, on the one hand, and uniform illumination of the part area on the other, and thus high quality of the images so generated.

According to a further developed embodiment of the invention, where the transillumination platform is arranged in any desired manner within the environment of the metal sheet folding machine, a benefit is gained in that the transillumination platform can be arranged in a site within the environment of the metal sheet folding machine that is favorable with respect to the given space conditions, and that the transillumination platform can be easily replaced when sheet metal parts with different dimensions have to be processed.

With a design variation where the transillumination platform is arranged on a front side of the metal sheet folding machine, particularly of a press table, that is facing the manipulator, the benefit gained is that the transillumination platform is located in an exactly defined position in relation to the manipulator or metal sheet folding machine, and that only short distances of travel and manipulation times ensue from its direct proximity relative to the metal sheet folding machine, which permits increasing the accuracy and reducing the cycle time.

It is beneficial also in this connection that the transillumination platform is arranged in an approximately vertical position, which minimizes the space requirements and permits a compact structure of the folding machine.

In another further developed embodiment of the invention, the optoelectronic measuring device is associated with the transillumination platform, which is advantageous in that high accuracy and quality of the measurement is achieved due to the exactly defined, fixed position of the measuring device.

With another design variation, it is advantageous that the optoelectronic measuring device is arranged on the gripper head of the manipulator, so that high flexibility with respect to the desired receiving position is achieved in this way, and, furthermore, the cycle time is kept short because no measuring device has to be additionally picked up by the gripper.

It is possible that the image acquisition means is formed by at least one CCD camera, which entails the benefit that well-tested technology can be employed, permitting its realization at favorable cost and, furthermore, data that are already available digitally.

It is also beneficial if the transillumination platform comprises means for determining the position because the exact position of the platform can be determined in this way in a simple manner in order to calibrate the system and to safely and precisely deposit the metal sheet parts in this way.

If the transillumination platform has from one to maximally three part areas spaced from one another, the ensuing benefit is that even metal sheet parts that are very similar to one another, can still be safely distinguished from each other, while the illumination platform will nonetheless exhibit high stability.

According to a further developed method, whereby the level of the metal sheet part is determined with the measuring system and the position of its receiving position is roughly determined before it is picked up for the first time, a benefit is gained in that no complicated readying systems for picking up the metal sheet parts with the manipulator are needed because the metal sheets have not to be made available in defined numbers or layers.

According to another variation, where the level of the pick-up position of the metal sheet part is determined with the measuring system before the metal sheet is picked up for the first time, the benefit of a short cycle time is gained because the position of the sheet can be corrected by the gripper head when the sheet is picked up again after it has been deposited on the transillumination platform, without requiring any additional measurement of its position.

It is possible also to compare in the computer the acquired outline data with data, particularly CAD data of the metal sheet part stored in a memory, and to then release the metal sheet part for further processing after is has been positively identified. In this way, the identity of the metal sheet parts can be safely and quickly controlled, and, furthermore, use can be made of CAD data material that is already available.

Generation of a fault message by means of the computer in case an identification is negative, and sorting out of the metal sheet part so identified is beneficial in that only metal sheets intended for the folding process will be inserted in the metal sheet folding machine. Damage to the plant can be avoided in this manner, and rejects and time can be saved.

BRIEF DESCRIPTION OF THE DRAWINGS

In the interest of better understanding of the invention, the latter is described in greater detail in the following with the help of the following figures each showing the following in a schematically simplified form.

DETAILED DESCRIPTION OF PREFERRED EMBODIMENTS

It is noted by way of introduction that in the different embodiments described in the following, identical parts are provided with identical reference numbers or component designations, whereby the disclosures contained throughout the specification are applicable in the same sense to identical components with identical reference numbers or identical component designations. Furthermore, positional data selected in the specification such as, for example top, bottom, laterally etc., relate to the directly described and shown figure, and have to be applied in the same sense to the new position where a position has changed. Moreover, individual features and combinations of features in the different exemplified embodiments shown and described herein may represent independent inventive solutions, or solutions as defined by the invention.

The exemplified embodiment shows a possible design variation of the metal sheet receiving system as defined by the invention and characterized in the claims, whereby it is noted herewith that the invention is not limited to the exemplified embodiment specifically shown herein, but that various other embodiments of the invention are possible as well, and that due to the instruction for technical execution provided by the present invention, such variation possibility falling within the scope of the technical skills of the expert engaged in the present technical field. Furthermore, all conceivable design variations feasible by combining individual details of the design variation shown and described herein, are jointly covered by the scope of protection.

Figure 1:
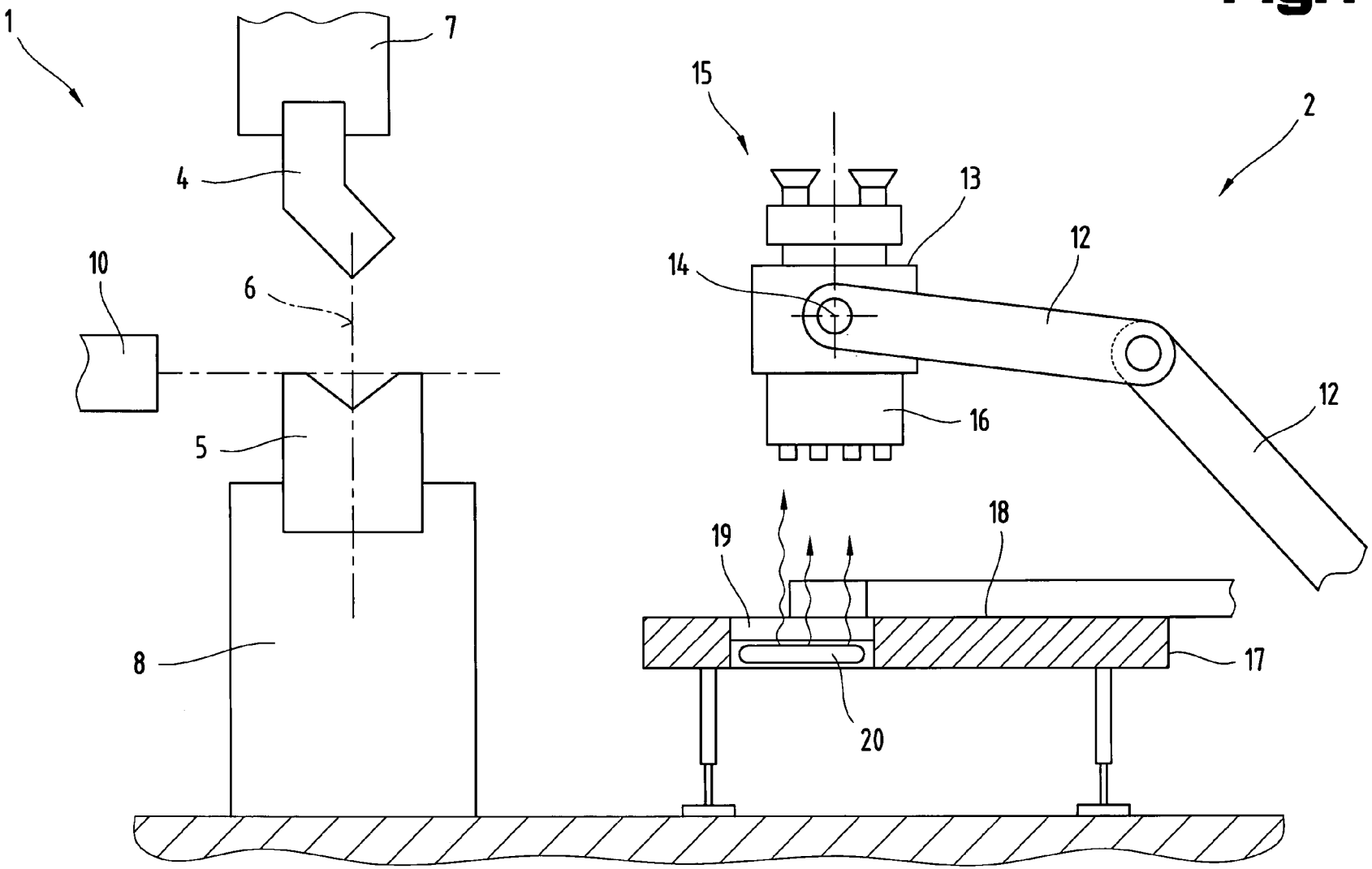
FIG. 1 is a first design variation of a metal sheet receiving system as defined by the invention, shown by a schematic representation.

FIG. 1 is a schematic representation of a folding press 1 with the metal sheet receiving system 2 as defined by the invention.

The metal sheet parts 3 are reshaped, for example into sections or housing parts in the folding press 1 of the metal sheet receiving system 2 as defined by the invention. In this folding process, the metal sheet part 3 is reshaped between a top die 4 and a bottom die 5 in a folding plane 6 extending perpendicularly to the set-up surface.

The top and bottom dies 4 and 5, respectively, are connected with an adjustable press beam 7 and stationary press table 8, respectively. For reshaping the metal sheet part 3, the latter comes to rest on the lower die 5 against a stop 10 at the level of the working plane 9.

A manipulator 11 is comprised of a plurality of the hinged arms 12, whereby the latter may be arranged in an end area on a displaceable undercarriage (not shown in FIG. 1). At least one rotationally supported gripper head 13 is arranged in another end area of the manipulator 11, whereby a rotation axle 14 is disposed in the plane of the working plane 9.

Furthermore, the gripping means 15 are arranged on the gripper head 13. Such gripping means may be formed, for example by a vacuum gripping system, which may be fitted, for example with suction cups, and may be formed by a device provided with the required supply channels.

The gripping means 15, of course, may by formed by other design variations as well, for example such as magnetic grippers or mechanical tong grippers.

It is noted here that the number of hinged arms 12 of the manipulator 11 is not limited to the design variation shown in FIG. 1, and that their number and the arrangement of the rotation axles 14 can be adapted to the requirements in a given case. In particular, it is naturally possible also that the rotation axle 14 of the gripper head 13 extends in a direction parallel to the hinged arm 12 arranged thereon in order to permit additional degrees of freedom of mobility.

Furthermore, an optoelectronic measuring device 16 may be arranged on the gripper head 16. Such a measuring device 16 is preferably secured on a side of the gripper head 13 disposed opposite the gripping means 15. However, it is possible also to arrange the optoelectronic measuring device 16 on the same side of the gripper head 13 where the gripping means 15 are arranged, or to arrange the gripping means 15 and the optoelectronic measuring device 16 in a common device on the gripper head 13.

The optoelectronic measuring device 16 is particularly adapted to acquiring information about the metal sheet parts 3 to be processed, such as, for example the type of metal sheet being processed, the outline, the position thereof, etc. The optoelectronic measuring device 16 is preferably formed by a means for acquiring an image, for example an electronic camera. In a preferred embodiment, such a camera may be formed by a camera operating based on a CCD-element. Possible are also line cameras having only individual image lines, whereby the required image acquisition area is scanned in the form of a translatory movement, if need be.

It is naturally possible also that the image acquisition means is formed by a number of cameras, particularly CCD cameras. The image acquisition means may preferably comprise a camera for rough recognition and a camera for fine recognition.

The position required for positioning the image acquisition means and its required spacing from the metal sheet parts 3 can be determined, for example by means of the camera for rough recognition and a laser arranged on the image acquisition means, with such laser projecting a characteristic marking on the uppermost metal sheet 3, for example a cross, e.g. by means of a triangulation method known from the prior art.

However, other methods and techniques for determining the spacing such as, for example ultrasound measurements or other travel time measurements, and measurements by distance sensors of the conventional type can be employed as well.

According to the invention, however, it is possible also to pick up the metal sheet parts 3 with the manipulator 11 without any further determination of the position, i.e., only by means of determining the level or spacing in a receiving position only roughly preset previously, and to then determine their position only in the subsequent fine recognition process.

The metal sheet parts 3 can be gripped also without any determination of the position or level, in which case the receiving position has to be determined first by inputting or acquiring the position of the stacks of sheets, and is then corrected by the respective sheet thickness values in accordance with the sheets received.

Rough recognition and/or fine recognition of the metal sheets 3 may take place based on the CAD data acquired in the planning or engineering stage, which are stored in a computer of the electronic controller. Samples are generated based on said data, which are searched in the generated image, and the respective metal sheet 3 is then released if it corresponds with the sample.

Rough and fine recognition can be realized also by means of one single optoelectronic measuring device 16, particularly a camera.

The optoelectronic measuring device 16 is a component of a measuring system furthermore comprising a transillumination platform 17.

Processing of the image has to meet special requirements so that the metal sheets 3 can be seized in exact positions. Important components are in this connection the optoelectronic measuring device 16, as well as the illumination in the form of the transillumination platform 17 as defined by the invention.

The transillumination platform 17 can be arranged in any desired site within the proximity of the metal sheet folding machine or folding press 1, and it can be provided with means for determining the position. Such means may be formed, for example by reference marks or other clear markings provided on the transillumination platform 17, whereby it is necessary once for calibration purposes to first determine the position of the transillumination platform 17 by means of the optoelectronic measuring device 16.

After rough recognition of the position of the metal sheet 3 on a stack of metal sheets has been completed and the level has been measured, the metal sheet part 3 picked up by the gripper head 13 is first deposited on the transillumination platform 17. An image of the metal sheet 3 is subsequently acquired by the optoelectronic measuring device 16 of the measuring system, and then supplied to a computer for determining the outline data. Such determination of the position or fine recognition of the metal sheet parts 3 then permits the gripper head 13 or gripping means 15 to be attached to the metal sheet part 3 in a corrected position in order to exactly position it in the metal sheet folding machine, particularly the folding press 1 as required.

In this connection, the transillumination platform 17 may form a support surface 18 for the metal sheet parts 3.

It is possible according to the invention that the part areas 19 of the support surface 18 are formed by a transparent material. Such part areas 19 may be formed, for example by glass or a highly transparent plastic, and their size and arrangement on the support surface 18 of the transillumination platform 17 can be individually adapted to the requirements. Furthermore, according to the invention, up to three parts areas 19 may be formed spaced from one another as well, so that a safe distinction between metal sheets 3 that are very similar to each other, is still possible, with the transillumination platform 17 nonetheless exhibiting high stability.

Furthermore, it is possible also that on the side facing away from the support surface 18 for the metal sheets 3, the transillumination platform 17 is provided with an illumination system 20. The illumination intensity is selected in this connection in such a way that adequate contrast is obtained for generating an image with the optoelectronic measuring device 16 without, however, causing any overexposure and thus poor quality of the image.

Furthermore, in order to further enhance the quality of the image, provision can be made for electronic adaptation of the exposure time and/or change in the number of images generated.

Furthermore, it is possible to provide the illumination system 20 of the transillumination platform 17 with illumination means extending over at least 30% of the surface area of the part areas 19. This enhances the quality of the images due to uninterrupted illumination of the surface area, as well as a constant contrast ratio.

Moreover, the quality of the transparent material of the part areas 19 of the support surface 18 preferably may be such that diffuse scattering the light rays emitted by the illumination system 20 is achieved, which also entails an improvement of the generated image owing to a constant contrast ratio over the entire surface area of the part area 19.

According to another embodiment of the invention, it is possible also to arrange the transillumination platform 17 on a front side of the folding press 1 facing the manipulator 11, particularly the press table 8. In this connection, the transilluminaion platform 17 may be preferably arranged in a vertical position (not shown in FIG. 1). It is beneficial in this connection if the optoelectronic measuring device 16 is associated with the transillumination platform 17, and positioned in a suitable position with a suitable spacing from the transillumination platform 17. The position of the optoelectronic measuring device 16 may be adjustable, so that its position can be corrected in a simple manner. Provision may be made in this connection for an additional optoelectronic measuring device 16 for determining the receiving position of the metal sheets 3.

Figure 2:
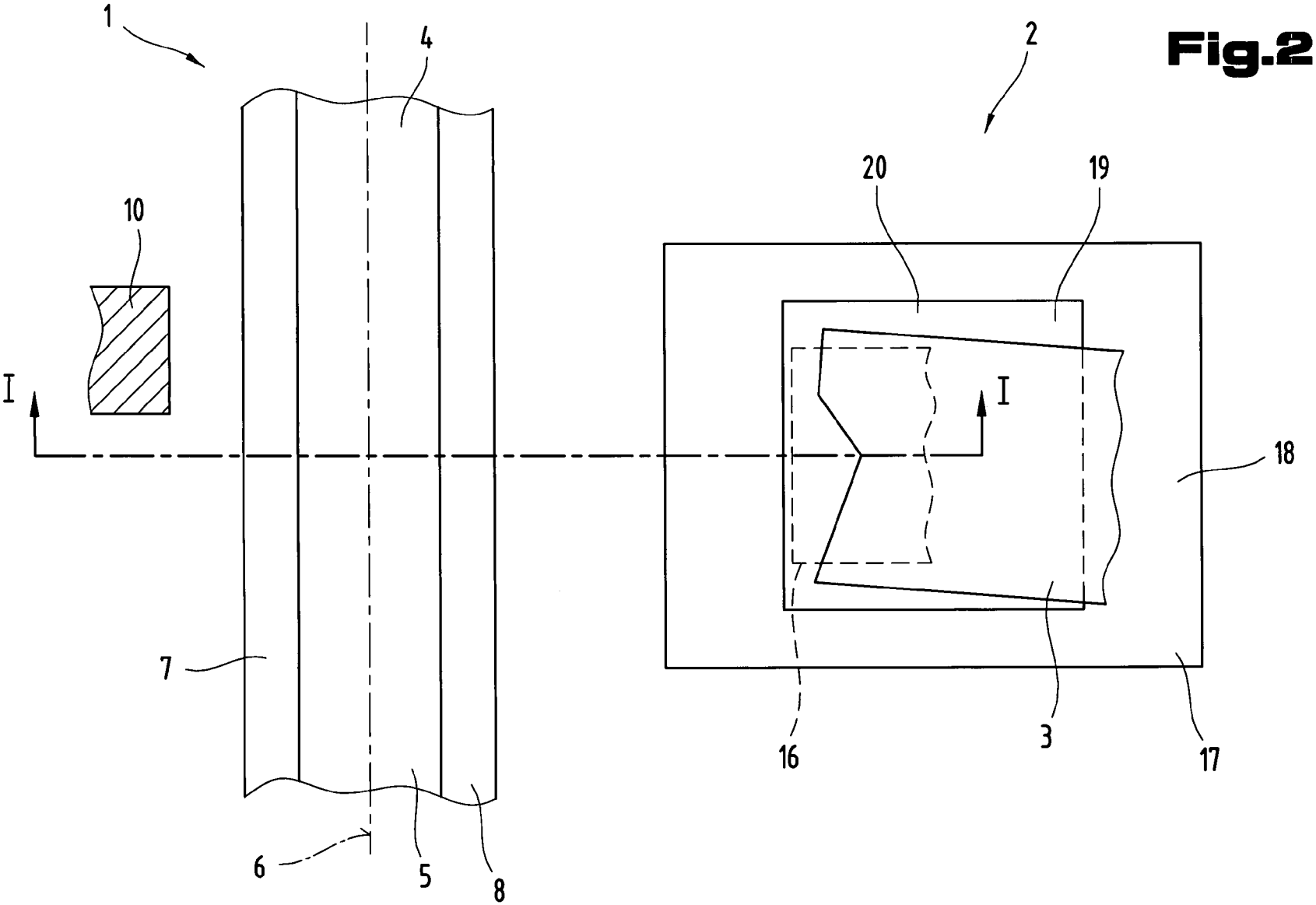
FIG. 2 is a top view of the metal sheet receiving system as defined by the invention.

FIG. 2 shows a schematic top view of the metal sheet receiving system 2 as defined by the invention.

Shown is a top view of a folding press 1 with the metal sheet receiving system 2 as defined by the invention. The manipulator 11 from FIG. 1 is not shown for the sake of clarity, but only the optoelectronic measuring system 16, which is mounted on the gripper head 13 of the manipulator 11 according to FIG. 1.

The transillumination platform 17 forms a support surface 18 for the metal sheets 3. Furthermore, a part area 19 of the transillumination plates is formed, which may consist of a transparent material such as, for example glass or a transparent plastic.

An illumination system 20 is arranged on a side of the part area 19 or support area 18 facing away from the metal sheet part 3. Said illumination system is preferably formed over at least 30° of the surface area of the part area 19.

It is possible also according to the invention to arrange several transparent part areas 19 on the transillumination platform 17, and to illuminate characteristic areas, for example when larger or highly similar metal sheets 3 or processed.

It is beneficial if markings representing a reference position of the three-dimensional position of the transillumination platform 17 are provided on the transillumination platform 17.

The metal sheet 3 can be deposited on the transillumination platform 17 and the gripper head 13 can be rotated around the rotation axle 14 in order to determine by means of the optoelectronic measuring device 16 the deviation of the position of the metal sheet 3 on the support surface 18 from the desired nominal position. The metal sheet 3 is now seized by the gripper head 13 with the help of the gripping means 15 in a corrected position and supplied to the folding press 1 in the position that is correct for the folding process. With a design variation where the optoelectronic measuring device 16 and the gripping means 15 are arranged on the same side of the gripper head 13, or the gripping means 15 and the optoelectronic measuring device 16 are jointly arranged in a common device on the gripper head 13, depositing of the metal sheet 3 and turning of the gripper head 13 can be omitted.

Furthermore, it is possible to arrange the transillumination platform 17 not separately from the folding press as shown in FIG. 2, but in a suitable position on the folding press 1, as it has already been explained in detail above in connection with FIG. 1.

Owing to the background illumination of the metal sheets 3 by means of the illumination system 20, reflections and influences of scattered light are avoided to the greatest possible extent, so that an optimal contrast ratio is achieved for generating the image and computer-assisted further processing of the outline data acquired from such image generation.

An improved quality of the image is obtained with the metal sheet receiving system 2 as defined by the invention particularly in connection with reflecting or galvanized or chromium-plated surfaces which means that it is possible to reduce the cycle time, on the one hand, and also the expenditure in terms of measuring technology on the other, which would be required otherwise for obtaining flawless images, such as, e.g. angular alignment of direct illumination, or for example generation of summation images from a number of individual images for reducing reflection. This, in turn, reduces the cycle time and processing expenditure.

Furthermore, it is possible to equip the optoelectronic measuring device 16 as defined by the invention—which is preferably formed by an electronic camera—with suitable lenses for adapting the focal length. By providing said measuring system with an arrangement comprising a camera for rough and a camera for fine recognition, it is of course possible to employ different lenses.

For determining the spacing, it is possible to employ on the gripper head 13 an additional diode laser for projecting onto the metal sheets 3 a marking serving for the determination of the spacing.

The metal sheets 3 are positioned in the folding press 1 for detecting a characteristic area of the metal sheet 3 in accordance with the specifications of a manufacturing program for producing a workpiece. Such specifications can be acquired by means of a computer directly from the engineering phase, particularly the CAD data.

The electronic controller for controlling the movements of the manipulator 11 can be integrated in the computer and may assume at the same time the function of recognizing the metal sheet.

If the optoelectronic measuring device 16 or transillumination platform 17 is directly arranged on the metal sheet folding machine, the metal sheet 3 is not seized again after its position has been recognized, but the position of the gripper head 13 or metal sheet 3 is directly corrected, and the latter is fed to the folding press 1 in the position correct for the folding process.

It is finally pointed out for the sake of good order that in the interest of superior understanding of the structure of the metal sheet receiving system 2, the latter or its components are shown to some extent untrue to scale and/or enlarged and/or reduced.

The problems on which the independent inventive solutions are based are described in the specification.

Most important of all, the individual exemplified embodiments shown in FIGS. 1 and 2 may constitute the object of independent solutions as defined by the invention. The respective problems and solutions as defined by the invention are specified in the detailed descriptions of said figures.

What is claimed is:

1. A metal sheet-receiving system for receiving metal sheets and feeding a metal sheet-folding machine, particularly a folding press, comprising at least one manipulator for seizing and moving metal sheet parts with a gripper head fitted with gripping means; an electronic controlling device for controlling the movements of the manipulator; as well as a measuring system for determining the position of the metal sheet parts, wherein the measuring system is formed by an optoelectronic measuring device comprising an image acquisition means, and a transillumination platform, wherein the transillumination platform is structured and arranged to receive one of the metal sheet parts gripped by the gripping means and moved by the manipulator onto the transillumination platform prior to the metal sheet part being fed into the sheet-folding machine, wherein the image acquisition means is structured and arranged to acquire an image of an outline of a portion of the metal sheet part on the transillumination platform and to detect a position of the metal sheet part with respect to the transillumination platform; and the electronic controlling device storing outline data for metal sheet parts and being operable to make a comparison between the image and position acquired by the image acquisition means and the stored outline data and to compute a new gripping position for the gripper head or a corrected position for the metal sheet part, and to cause the manipulator to re-position the gripper head in the new gripping position or to move the metal sheet part into said corrected position based on said comparison, such that the manipulator can feed the metal sheet part in a desired position into the sheet-folding machine.

2. The metal sheet-receiving system according to claim 1, wherein the transillumination platform forms a support surface for the metal sheet parts.

3. The metal sheet-receiving system according to claim 2, wherein part areas of the support surface are formed by a transparent material.

4. The metal sheet-receiving system according to claim 3, wherein the transillumination platform comprises an illumination system extending on a side facing away from the support surface for the metal sheet parts over at least 30% of a total surface area of the part areas.

5. The metal sheet-receiving system according to claim 1, wherein the transillumination platform is arranged in any desired site within the environmental area of the metal sheet folding machine.

6. The metal sheet-receiving system according to claim 1, wherein the transillumination platform is arranged on a front side of the metal sheet folding machine facing the manipulator, particularly of a press table.

7. The metal sheet-receiving system according to claim 6, wherein the transillumination platform is arranged in an approximately vertical position.

8. The metal sheet-receiving system according to claim 1, wherein the optoelectronic measuring device is associated with the transillumination platform.

9. The metal sheet-receiving system according to claim 1, wherein the optoelectronic measuring system is arranged on the gripper head of the manipulator.

10. The metal sheet-receiving system according to claim 1, wherein the image acquisition system is formed by at least one CCD-camera.

11. The metal-sheet-receiving system according to claim 1, wherein the transillumination platform comprises means for determining the position.

12. The metal sheet-receiving system according to claim 1, wherein the transillumination platform comprises from one up to maximally three part areas spaced from one another.

13. A method for receiving metal sheet parts from a stack of metal sheets and for positioning such metal sheets in a metal sheet folding machine, particularly a folding press by means of a metal sheet-receiving system comprised of at least one manipulator for seizing and moving the metal sheet parts with a gripper head fitted with gripping means; an electronic controlling device for controlling the movements of the manipulator; as well as a measuring system for determining the position of the metal sheet parts, wherein the metal sheet part is picked up with the gripping means of the manipulator and fed to a transillumination platform; an illumination system illuminates at least part areas of the transillumination platform from the a side facing away from the gripping means of the manipulator; an optoelectronic measuring system of the measuring system acquires an image of a portion of the metal sheet part, and detects a position said portion of the metal sheet part with respect to the transillumination platform; a computer storing outline data for metal sheet parts makes a comparison between the stored outline data and the image and position acquired by the optoelectronic measuring system; a new gripping position or correction of the position of the gripper head is computed based on such comparison; and the gripper head picks up the metal sheet part in said new gripping position or corrects the position of the metal sheet part, and feeds said metal sheet part to the metal sheet-folding machine.

14. The method according to claim 13, wherein before the metal sheet part is picked up for the first time, a level of the metal sheet part is determined with the measuring system and a receiving position of the metal sheet part is roughly determined.

15. The method according to claim 13, wherein before the metal sheet part is picked up for the first time, a level of a receiving position of the metal sheet part is determined with the measuring system.

16. The method according to claim 13, wherein the determined outline data are compared by the computer with CAD-data stored in a memory device, and the metal sheet part is released for further processing upon positive identification.

17. The method according to claim 16, wherein upon negative identification, a fault message is output by the computer and the metal sheet part is sorted out.

* * * * *

UNITED STATES PATENT AND TRADEMARK OFFICE

CERTIFICATE OF CORRECTION

PATENT NO. : 7,201,032 B2
APPLICATION NO. : 11/071983
DATED : April 10, 2007
INVENTOR(S) : Pfitzner It is certified that error appears in the above-identified patent and that said Letters Patent is hereby corrected as shown below:

Column 10,

Line 24, after "platform from" cancel "the".

Signed and Sealed this

Third Day of July, 2007

JON W. DUDAS
*Director of the United States Patent and Trademark Office*